United States Patent [19]

Horgan et al.

[11] Patent Number: 5,004,044

[45] Date of Patent: Apr. 2, 1991

[54] COMPACT RECTILINEAR HEAT EXHANGER

[75] Inventors: John J. Horgan, Wethersfield; Val S. Ociepka, Bridgeport, both of Conn.

[73] Assignee: Avco Corporation, Providence, R.I.

[21] Appl. No.: 415,990

[22] Filed: Oct. 2, 1989

[51] Int. Cl.[5] ..... F28F 9/22; F28F 3/00; F02C 7/10

[52] U.S. Cl. ..... 165/145; 165/166; 60/39.511

[58] Field of Search ..... 165/145, 166; 60/39.511

[56] References Cited

U.S. PATENT DOCUMENTS

| | | | |
|---|---|---|---|
| 2,428,066 | 9/1947 | Ellis | 257/246 |
| 2,429,508 | 10/1947 | Belaieff | 257/139 |
| 2,650,073 | 8/1953 | Holm | 257/6 |
| 2,995,344 | 8/1961 | Hryniszak | 257/245 |
| 3,228,464 | 1/1966 | Stein et al. | 165/166 |
| 3,285,326 | 11/1966 | Wosika | 165/4 |
| 3,289,757 | 12/1966 | Rutledge | 165/166 |
| 3,327,771 | 6/1967 | Lecon | 165/10 |
| 3,385,353 | 5/1968 | Straniti et al. | 165/67 |
| 3,389,746 | 6/1968 | Straniti et al. | 165/9 |
| 3,516,482 | 6/1970 | Straniti et al. | 165/7 |
| 3,818,984 | 6/1974 | Nakamura et al. | 165/166 |
| 3,831,674 | 8/1974 | Stein et al. | 165/166 |
| 3,863,771 | 2/1975 | Beckmann et al. | 165/145 |
| 3,866,674 | 2/1975 | Tramuta et al. | 165/166 |
| 3,877,519 | 4/1975 | Tramuta et al. | 60/39.511 |
| 4,098,330 | 7/1978 | Flower et al. | 165/166 |
| 4,248,297 | 2/1981 | Pei | 165/166 |
| 4,327,803 | 5/1982 | Muellejans et al. | 165/166 |
| 4,379,487 | 4/1983 | Krakow | 165/165 |
| 4,431,050 | 2/1984 | Martin | 165/166 |
| 4,438,809 | 3/1984 | Papis | 165/166 |
| 4,470,453 | 9/1984 | Laughlin et al. | 165/166 |
| 4,470,454 | 9/1984 | Laughlin et al. | 165/166 |
| 4,506,502 | 3/1985 | Shapiro | 60/39.43 |
| 4,582,126 | 4/1986 | Corey | 165/82 |
| 4,606,745 | 8/1986 | Fujita | 62/64 |

FOREIGN PATENT DOCUMENTS

| | | | |
|---|---|---|---|
| 0120191 | 6/1985 | Japan | 165/166 |

*Primary Examiner*—John Rivell
*Assistant Examiner*—L. R. Leo
*Attorney, Agent, or Firm*—Perman & Green

[57] ABSTRACT

A heat exchange module for use with a plurality of similar modules to form a recuperator for use in an gas turbine engine. The module has a center section with a generally rectangular cross-sectional shape, a first side section with a generally triangular cross-sectional shape, and a second side section. The module can be combined with other modules to form a polygonal recuperator with a center aperture.

19 Claims, 6 Drawing Sheets

COMPACT RECTILINEAR HEAT EXHANGER

BACKGROUND OF THE INVENTION

1. Field of the Invention

The present invention relates to heat exchangers and, more particularly, to a heat exchange module for use in an improved heat exchanger assembly.

2. Prior Art

Various different types of heat exchangers are known in the art. U.S. Pat. No. 4,470,454 to Laughlin et al discloses a plate type annular heat exchanger. U.S. Pat. No. 4,431,050 shows a similar heat exchanger adapted for use as a regenerator for a gas turbine engine. U.S. Pat. No. 4,582,126 discloses an annular heat exchanger assembly having a plurality of members U.S. Pat. No. 3,289,757 to Ruthledge discloses a polygonal heat exchanger.

Various problems have arisen with annular heat exchangers. The principal problem is that the radial flow of hot gases in an annular heat exchanger from an inner aperture or circumference to an outer circumference results in unequal temperatures in a thermally inflexible system. Typically, with radial outflow of hot gases, this results in a relatively hot section near the inner aperture and a relatively cool section near the outer circumference. In the prior art plate-type heat exchangers, this leads to high plate stresses, especially when the inlet temperatures are not uniform, thus reducing the working life of the heat exchanger.

Another problem is that the total heat transfer area in radial outflow annular heat exchangers is limited due to the need to collect the exhaust gas for discharge through a single outlet within a minimum system volume.

A further problem with annular heat exchangers of the prior art is that they are not easy to manufacture, repair, or replace.

It is therefore an objective of the present invention to provide an annular heat exchanger having rectilinear heat exchange fluid flow paths with improved heat transfer between fluids.

It is another objective of the present invention to provide an annular heat exchange assembly which achieves thermal flexibility by construction of a heat exchange module that can be used with similar modules to form an annular heat exchanger with a rectilinear heat transfer means.

It is another objective of the present invention to provide a heat exchange module that can be used with similar heat exchange modules to form different polygonal shaped heat exchangers which can provide maximum heat transfer for a specified volume in which the heat exchanger must operate.

It is another objective of the present invention to provide a heat exchange module for use in an annular heat exchanger that can be easily replaced.

SUMMARY OF THE INVENTION

The foregoing problems are overcome and other advantages are provided by a heat exchange module having a center section with a rectilinear heat transfer means and a side section with at least one air conduit.

In accordance with one embodiment of the invention, a heat exchange module is provided for use with a plurality of similar modules to form a recuperator for use in a gas turbine engine. The module comprise a center section, a first side section and a second side section.

The center section has a generally rectangular cross-sectional shape with a first gas inlet side, a second opposite gas outlet side and a heat transfer means. The heat transfer means comprises means for conduiting gases from the gas inlet side to the gas outlet side, means for conduiting air through the center section and heat transfer surface means for transferring heat from the gases to the air in the heat transfer means. The first side section has a generally triangular cross-sectional shape with a first air conduit therein communicating with the means for conduiting air in the center section. The module can be placed adjacent to similar modules to help form a recuperator with a center aperture having first gas inlet sides of the modules substantially defining the center aperture.

In accordance with another embodiment of the invention, a gas turbine engine is provided having at least five heat exchange modules forming a recuperator located in a gas exhaust collector means. Each module has a center section with a relatively rectangular cross-sectional shape and at least one side section with a relatively triangular cross-sectional shape. the center section has a heat transfer means therein and the side section has at least one air conduit for conduiting air into the center section. Each module has a first side formed by the side section and a second opposite side and the modules form a polygonal loop with the first gas inlet sides of the modules substantially forming a recuperator center aperture The gas exhaust collector means comprises an exhaust gas collector having a generally U-shaped cross-section with a gas inlet at a front section and a gas outlet at a top section. The recuperator is located in the collector with a space between the recuperator and the collector whereby gases can enter the recuperator center aperture, pass through the center sections, and exit the recuperator at the space while transferring heat to air passing through the recuperator.

In accordance with another embodiment of the invention, an annular heat exchange apparatus is provided for radially conduiting a first fluid from a center aperture to an outer perimeter and adapted for conduiting a second fluid through the apparatus. The apparatus comprises a plurality of heat exchange modules and a plurality of second fluid conduit members. The heat exchange modules each have a rectilinear heat exchange means with a first fluid inlet side at the center aperture. The first fluid inlet sides substantially define the center aperture. The plurality of second fluid conduit members are located between adjacent modules for conduiting the second fluid into the modules.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
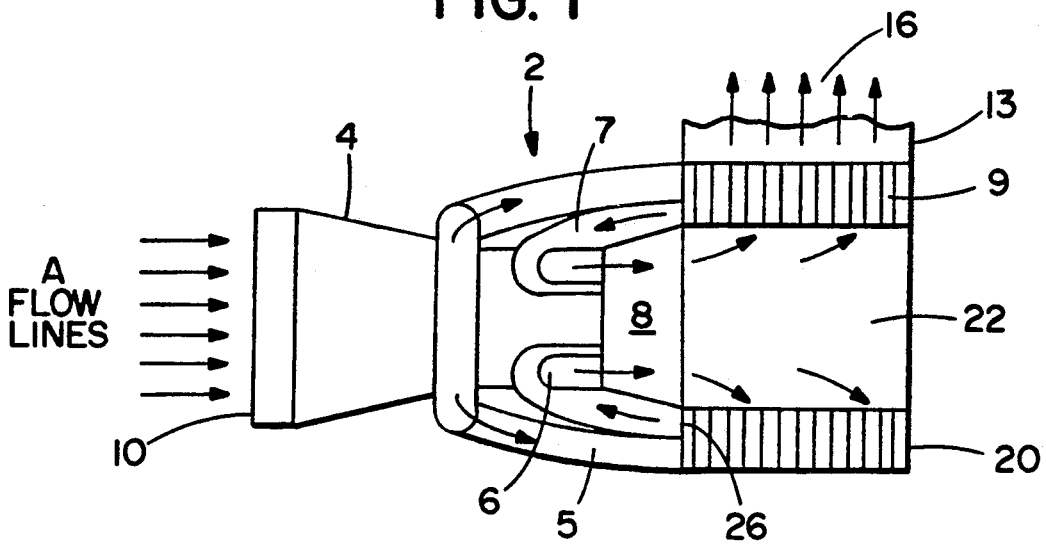
FIG. 1 is a schematic view of a gas turbine engine.

Referring to FIG. 1, a schematic view of a gas turbine engine 2 is shown. The gas turbine engine of FIG. 1 is merely shown as a representational apparatus in which a heat exchanger is employed It should be understood that the heat exchanger of the present invention is intended for use in all types of heat exchange applications and is not intended to be limited to use as a recuperator or a regenerator in gas turbine engines.

The engine 2 in FIG. 1 is a recuperator cycle engine and generally has four main sections; an air compressor section 4, a combustion section 6, a drive turbine section 8 and a recuperator section 9. The air compressor section 4 takes in air at the inlet !0 as shown by flow arrows A and compresses the air for introduction into passages 5 leading to the recuperator section 9 where the air is heated by the exhaust gas. The heated pressurized air then exits from the recuperator section, flowing through passages 7 to the combustion section 6. The combustion section 6 may have one or more combustors. The heated air is directed into the combustors with fuel also being introduced and mixed with the air to provide an appropriate mixture for efficient combustion. Spent fuel, hot gases from combustion and additional cooling air are then forced into the turbine section 8 and exit the turbine section 8 into a center aperture 22 in the recuperator section 9. The turbine section 8 may have one or more stages and may be divided to drive the compressor and load through one or more shafts. The hot exhaust gas, in the embodiment shown, flows radially outward through a recuperator 20 where heat is exchanged with the compressor discharge air. The cooled exhaust gas then enters an area 72 (see FIG. 5) between the recuperator 20 and a gas collector 13 The gas collector 13 has a generally U-shaped cross-section with a gas outlet section 16 where the combined gas flow from modules 24 of the recuperator 20 exit from the system.

Figure 2A:
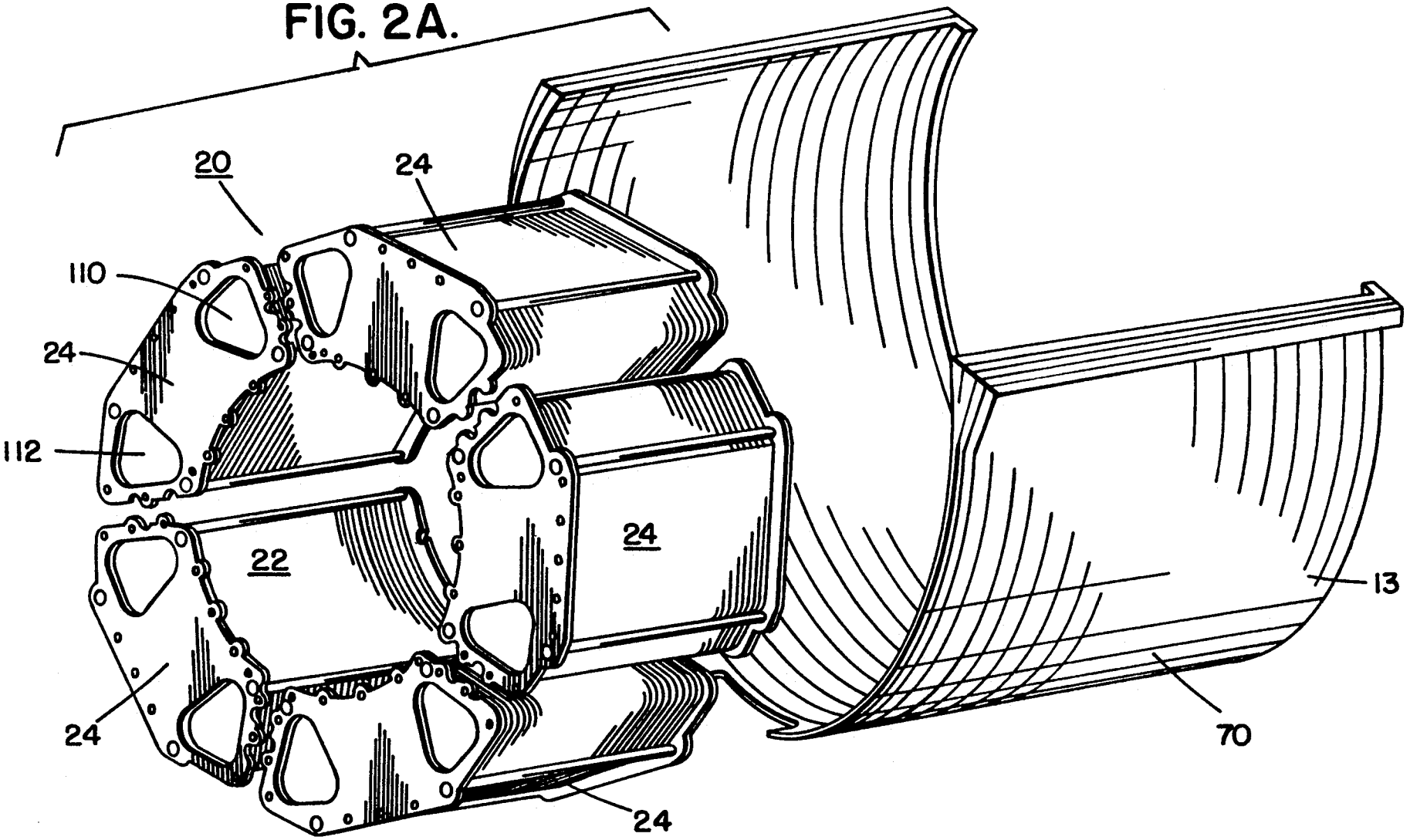
FIG. 2A is an exploded perspective view of a recuperator incorporating features of the present invention and a gas collector.
Figure 2B:
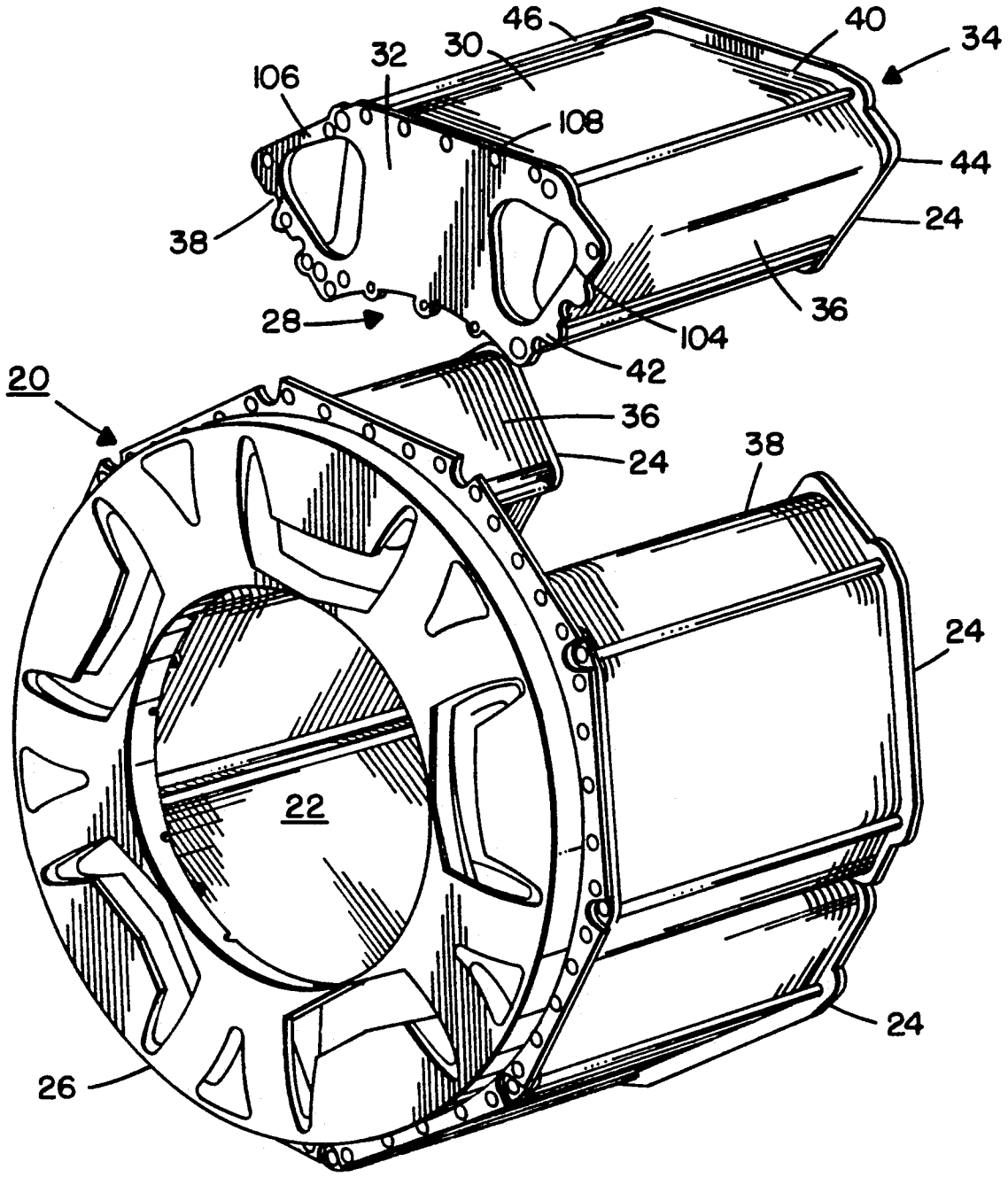
FIG. 2B is a perspective view of a recuperator incorporating features of the present invention with an exploded view of a heat exchange module.

Referring also to FIGS. 2A and 2B, there are shown exploded perspective views of heat exchangers or recuperators 20 incorporating features of the present invention. The recuperator 20 shown in FIG. 2B is substantially the same as the recuperator shown in FIG. 2A except that the recuperator shown in FIG. 2B has an adaptor mounting plate 26 such that the present invention can be used with gas turbine engines presently in use. The recuperator 20, in the embodiments shown, is generally adapted for attachment to a gas turbine engine at a point downstream of the final turbine stage of the engine. The hot gas discharge from the engine enters a center aperture 22 of the recuperator 20 and then is directed radially outwardly through a plurality of heat exchanger modules 24. When assembled, the exhaust gases from the modules 24 are collected into the area 72 (see FIG. 5) between the recuperator 20 and collector 13 to be discharged through the top section 16. In the embodiments shown, the recuperator 20 generally comprises five heat exchange modules 24. However, any suitable number of modules can be used. The modules 24 form the annular recuperator 20 by locating the modules into a generally pentagonal shape with side sections 36 and 38 adjacent each other. Although the modules 24 are described as being adjacent, they are not rigidly attached to each other. The term adjacent is intended to indicate their close proximity and cooperating shape and also allow for the use of a thermally flexible seal to substantially prevent hot gases from leaking between adjacent modules. Each of the modules 24 have a front mounting plate 42 which is provided to mount the modules 24 to the turbine section 8 or, as shown in FIG. 2B, for mounting of the modules 24 to the adapter plate 26. In an alternate embodiment of the invention, the mounting plates 42 need not be provided. In another alternate embodiment of the invention, the mounting plates 42 could be modified or an additional plate added to adapt the recuperator for use in gas turbine engines presently in use, thereby allowing for replacement of prior art recuperators with a recuperator incorporating features of the present invention such as in shown in FIG. 2B. In a preferred embodiment, the modules 24 are cantilever mounted to the mounting plates 42 which are mounted to the turbine section 8. The mounting plates 42, in the embodiment shown, have suitable apertures 104 and 106 for conduiting air into and out of the modules 24. In the recuperators shown in FIG. 2A and 2B, each module 24 generally comprises a gas inlet side 28 which helps to substantially form the center aperture 22, an opposite gas outlet side 30, a front face 32, a rear face 34, a first side section 36 and a second side section 38. In the embodiment shown, each module 24 generally comprises a plurality of stacked plates to form a plate-type heat exchanger. The modules 24 also generally comprise the front mounting plate 42, a rear plate 44 and tie rods 46 which help to maintain the stacked integrity of the plates 40 in the module 24. In the embodiment shown, the front plates 42 comprises two air apertures 104 and 106 for allowing air to pass into and out of the modules 24 through the front plates 42. The plates 42 also comprise suitable holes 108 for use with bolts to mount the modules 24 to the mounting plate 26 or turbine section 8 In the embodiment shown, the recuperator is generally provided to use the relatively hot exhaust gases exiting the engine to pre-heat compressed air from the compressor section before introduction into the combustion section Although the modules 24 have been described as being formed from stacked plates, any suitable construction may be used.

Figure 3:
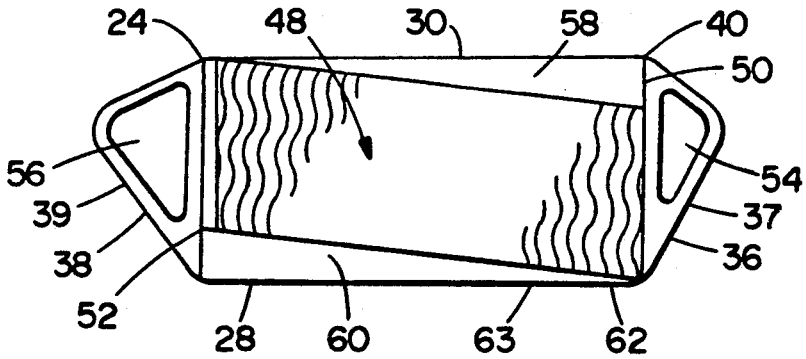
FIG. 3 is a schematic cross-sectional view of one of the modules shown in FIG. 2.

Referring also to FIG. 3, there is shown a schematic cross sectional view of one of the modules 24 of the recuperator 20 shown in FIG. 2. In the embodiment shown, the module 24 generally comprises a center section 48 located between the first side section 36 and second side section 38. The center section 48, in the embodiment shown, has a generally rectangular cross sectional shape with a first side at the gas inlet side 28, a second side at the gas outlet side 30, a third side 50 adjacent the first side section 36 and a fourth side 52 adjacent the second side section 38. The stacked plates 40, in the embodiment shown, each have portions such that when the plates are stacked they form the center section 48, first side section 36 and second side section 38. The first side section 36 has a generally triangular cross sectional shape with a relatively small portion proximate the first gas inlet side 28. In the embodiment shown, the first side section 36 comprises an air inlet conduit 54. In this embodiment the air inlet conduit 54 is also relatively triangular shaped. However, any suitable size, shape or number of air inlet conduits may be provided. In a preferred embodiment of the invention, the air inlet conduit 54 extends from the front face 32 to the rear face 34 of the module. When the plurality of plates 40 are fixed together the air inlet conduit 54 is formed. The first side section 36 has an angled face 37 which is intended to cooperate with an adjacent module to form the polygon-looped recuperator 20. The second side section 38 also has a generally triangular cross sectional shape with a relatively small portion proximate the gas inlet side 28.

Figure 3A:
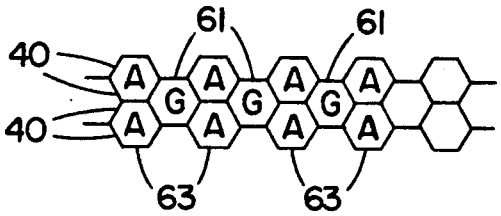
FIG. 3A is a partial schematic cross-sectional view of the center section shown in the module of FIG. 3.
Figure 3B:
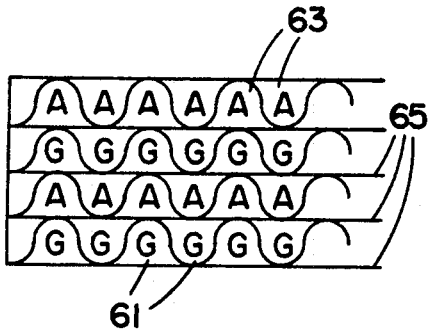
FIG. 3B is a partial schematic cross-sectional view of an alternate embodiment of the center section of the module shown in FIG. 3.
Figure 3C:
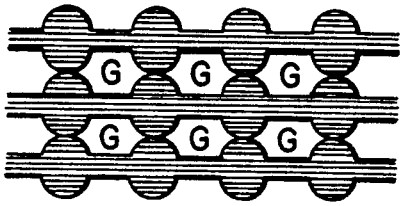
FIG. 3C is a partial schematic end view of the gas inlet region of the center section shown in the module of FIG. 3.
Figure 3D:
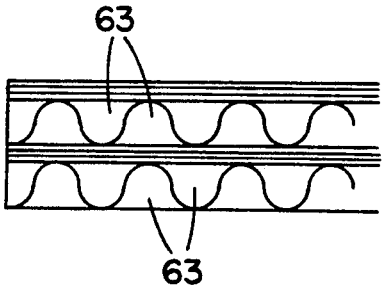
FIG. 3D is a partial schematic end view of the alternate embodiment of FIG. 3B.

The second side section 38 also comprises an air outlet conduit 56. In this embodiment the air outlet conduit 56 is also relatively triangular shaped However, any suitable size, shape or number of air outlet conduits may be provided In a preferred embodiment of the invention, the air outlet conduit 56 extends from the rear face 34 to the front face 32 of the module. As can be seen in FIG. 3, the first side section 36 and air inlet conduit 54 are relatively smaller than the second side section 38 and air outlet conduit 56 in this embodiment. This allows for the proper conduiting of air while taking into account the expansion of the air as it is heated in the center section 48. In this embodiment, the second side section 38 has an angled face 39 which is intended to cooperate with the angled face 37 of an adjacent module. Located proximate the gas outlet side 30 of the module 24 are a plurality of triangular shaped conduits 58 along the length of the module that communicate with the air inlet conduit 54 in the first side section 36. Located adjacent the gas inlet side 28 of the modules are a second plurality of triangular shaped conduits 60 along the length of the module which communicate with the air outlet conduit 56 in the second side section 38. Air conduits 58 and 60 provide for lateral flow in the air cells located between alternating air and gas paths of the modules 24. These crossflow regions 58 and 60 generally have different heat transfer surfaces than the center heat transfer section 62. Located between the first conduits 58 and second conduits 60 is the counterflow rectilinear heat transfer section 62. As can be seen, the heat transfer section comprises a plurality of relatively uniform fluid channels 63 comprising gas channels alternating with air channels that are generally perpendicular to the gas inlet side 28 and gas outlet side 30 of the module 24. In the embodiment shown, all of the channels 63 are substantially the same length and size. Gas channels are separated by air channels such that there is a uniform transfer of heat to the air. The triangular conduits 58 and 60 allow for the uniform entry and exit of air in the air channels 63. However, any suitable size or shape top and bottom air conduits 58 and 60 may be provided. The center heat transfer section 62, in the embodiment shown, generally comprises a plurality of sinusoidal heat transfer shapes. However, any suitable shape of heat transfer surface may be provided. Referring also to FIGS. 3A, B, C and D, the plates 40 will be further described. FIGS. 3A and 3C show partial schematic cross-sectional and end views of the plates 40, respectively As shown in FIG. 3A, the shape of the plates 40 form parallel gas channels 61 and air channels 63. Gases passing through the gas channels 61 can transmit heat to air, flowing in the opposite direction, passing through the air channels 63 via the plates 40. The hot gases and air are kept separated throughout the module. As shown in FIG. 3C, the air channels 63 are closed off at the gas inlet side such that the hot gases go into the gas channels 61. FIGS. 3B and 3D show an alternate embodiment of the invention. Relatively straight plates 65 separate gas channels 61 and air channels 63 with plates 40 therebetween and the air channels 63 are closed off at the gas inlet side.

Generally, air from the compressor section 4 of the engine 2 can be conduited to the recuperator 20 and forced into the air inlet conduits 54. The air can then travel into the first set of top conduits 58, into and through the heat transfer section 62 in the center section 48, into the plurality of second bottom conduits 60, into and through the air outlet conduit 56 and to the combustor section 6 of the engine 2. Relatively hot gases from the turbine section 8 pass into the center aperture 22 of the recuperator 20, into the modules 24 at the gas inlet side 28, through the heat transfer section 62 separated from the air by the plates 40, out the gas outlet sides 30 into the exhaust gas section 12. As the air is passed through the modules 24 the heat transfer section 62 allows heat from the gases passing through the center section 48 to be transferred to the passing air. The rectilinear flow paths of the hot gases and the air flowing through the modules 24 provides for an improved heat transfer between the fluids The rectilinear heat exchanger of the present invention also allows for thermal flexibility or substantially prevents unequal heat transfer or localized unequal heat transfer.

Figure 4:
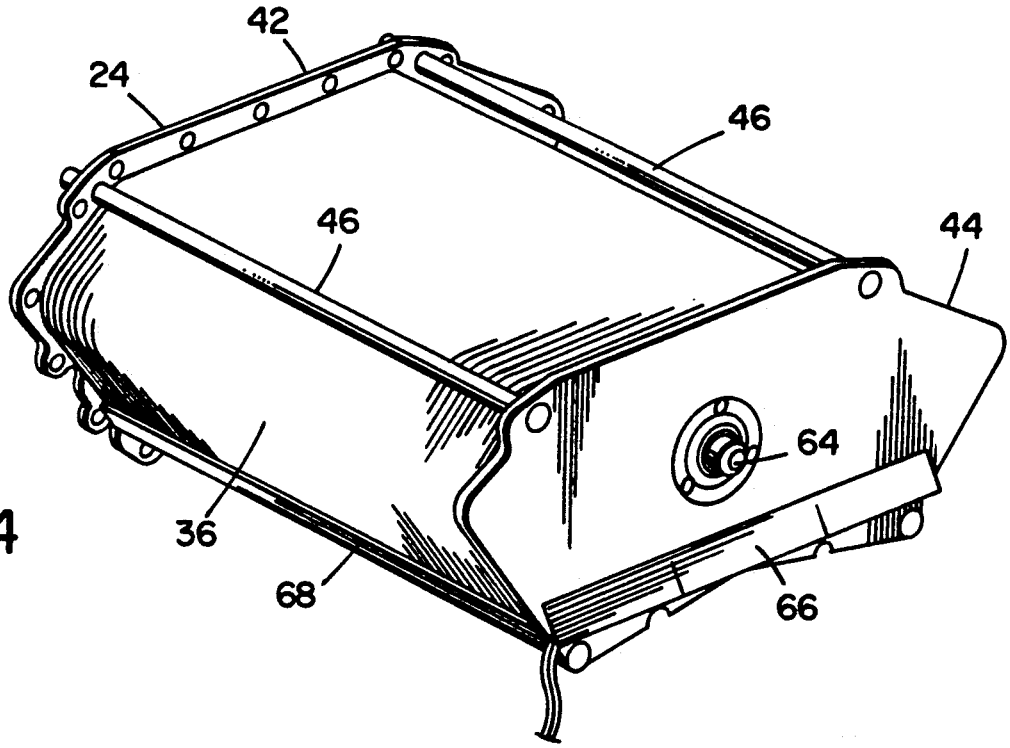
FIG. 4 is a perspective view of a rear side of one of the modules shown in FIG. 2.

Referring also to FIG. 4, there is shown a perspective view of a heat exchange module 24. The rear plate 44 can generally seal off the ends of the air inlet conduit 54 and air outlet conduit 56 of a module. A rear support pin 64 is generally provided on the rear plate 44. The rear plate 44 also comprises an end seal 66 for making a sealing contact with an end plate (not shown) which defines the downstream limit of the hot gas discharge flow path in the center aperture 22 so that all of the hot gases from the turbine section 8 may be turned radially outwardly through the modules 24. Located on both of the first side section 36 and second side section 38 is a brush seal 68 for making a sealing contact between adjacent modules 24. However, any suitable type of seal between modules may be provided. In an alternate embodiment of the invention, no seals need be provided between the modules 24.

Figure 5:
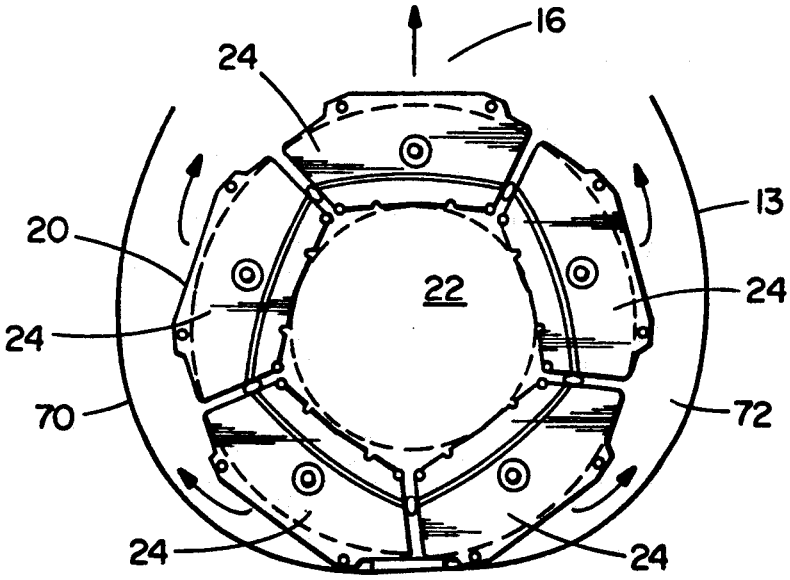
FIG. 5 is a schematic view of a recuperator incorporating features of the present invention shown inside a gas collector.

Referring also to FIG. 5, there is shown a schematic end view of the recuperator 20 in a gas collector 70. As shown in this embodiment, the five modules 24 generally form a polygon loop. Hot gases from the turbine section 8 of the engine 2 can generally pass through the modules 24 radially from the center aperture 22 and into a space 72 between the collector 70 and recuperator 20. Gases flowing into the space 72 can then travel upwardly and out the top section 16 of the exhaust gas section 12. The center aperture 22 is sufficiently sized to allow the turbine shaft to be partially positioned therein. As shown in this embodiment, two modules are located in close proximity with the bottom of the gas collector 70. However, due to the rectangular heat exchange sections of the modules 24 and the triangular shaped side sections 36 and 38, there is substantially no barrier or resistance to the flow of gases through the bottom two modules due to this close proximity and the gases can pass into the space 72 without significant flow problems. Generally, the first side section 36 of a first module will be placed adjacent the second side section 38 of an adjacent module to form the polygonal loop. Due to the triangular shape of the side sections 36 and 38, the center aperture 22 of the recuperator 20 is substantially established by the gas inlet sides 28 of the modules 24. This, in conjunction with the rectangular center sections of the modules and the triangular side sections for conduiting air into the center sections allows for an increased heat transfer surface area relative to recuperators known in the art.

Figure 6:
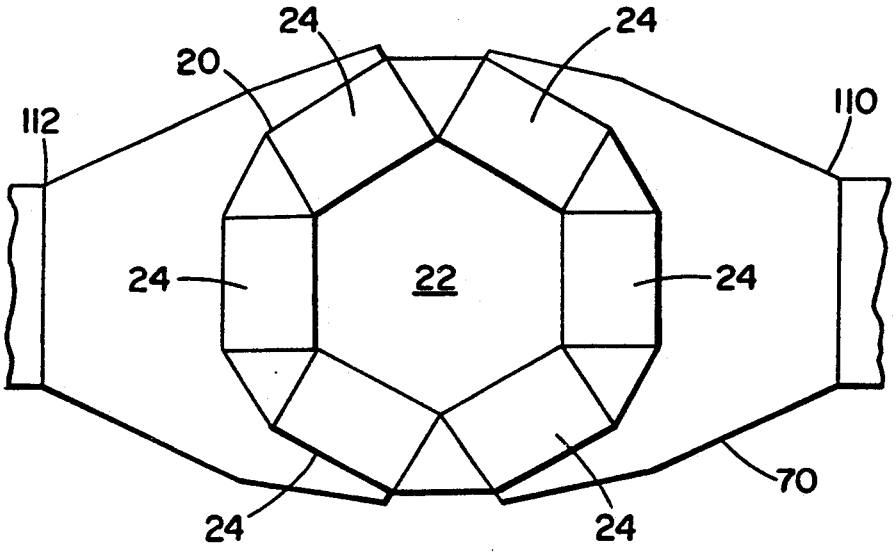
FIG. 6 is a schematic view of an alternate embodiment of the invention.

Referring now to FIG. 6, there is shown a schematic view of an alternate embodiment of the invention. In the embodiment shown, a recuperator 20 is shown in a gas collector 70. The recuperator 20 in this embodiment, generally comprises six modules 24 which form a hexagonal loop having a center aperture 22 and the collector has two exhaust gas outlets 110 and 112. Obviously, any suitable number of modules may be combined to form a polygonal loop. In the embodiment shown, the collector 70 is shown as a dual discharge collector to provide the most volume efficient recuperator. However, any number of modules or discharges may be used to optimize the configuration for a given installation. In addition, although the collector 70 is shown as a dual discharge collector, any suitable type of collector and discharge may be used.

Figure 7:
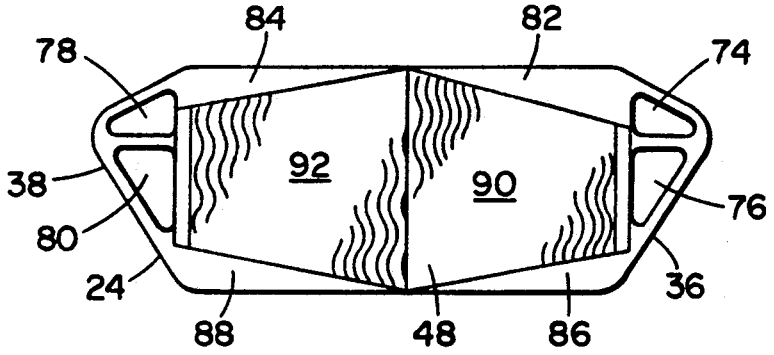
FIG. 7 is a schematic cross-sectional view of an alternate embodiment of the invention.

Referring now to FIG. 7, there is shown a schematic cross sectional view of an alternate embodiment of the invention. In the embodiment shown, a module 24 generally comprises a first side section 36 having a first air inlet conduit 74 and a first air outlet conduit 76 and a second side section 38 having a second air inlet conduit 78 and a second air outlet conduit 80. The center section 48 generally comprises a plurality of triangular shaped top conduits 82 and 84 and a plurality of triangular shaped bottom conduits 86 and 88. Unlike the embodiment shown in FIG. 3, the first and second side sections 36 and 38 are substantially identical to each other in this embodiment. Air can be conduited into the module 24 via the first and second air inlet conduits 74 and 78. The plurality of top conduits 82 and 84 can conduit the air from the first and second air inlet conduits 74 and 78 into the heat transfer section 90 and 92. Heated air from the heat transfer sections 90 and 92 can then enter the bottom conduits 86 and 88 and be conduited via the first and second air outlet conduits 76 and 80 to the combustor section of the engine.

Figure 8:
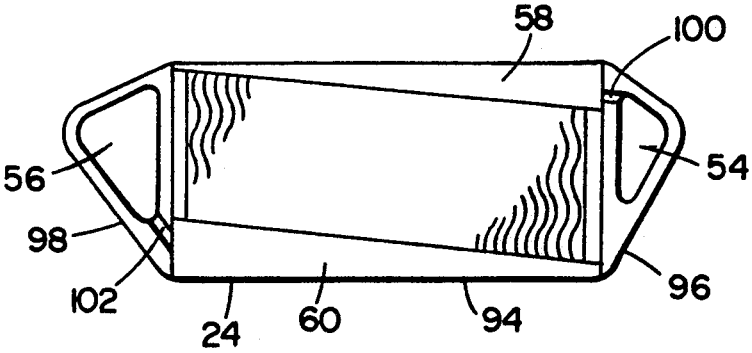
FIG. 8 is a schematic cross-sectional view of an alternate embodiment of the invention.

Referring now to FIG. 8, there is shown an alternate embodiment of the invention. In the embodiment shown, the module 24 is generally comprised of a rectangular center member 94 having a first side member 96 and a second side member 98 fixedly attached thereto. Thus, it is shown that the modules 24 need not be assembled from unitary plates 40, but may comprise various different members. In the embodiment shown, suitable conduits 100 are provided between the air inlet conduit 54 and the plurality of top conduits 58. In addition, suitable conduits 102 are provided between the bottom conduits 60 and the air outlet conduit 56.

Figure 9:
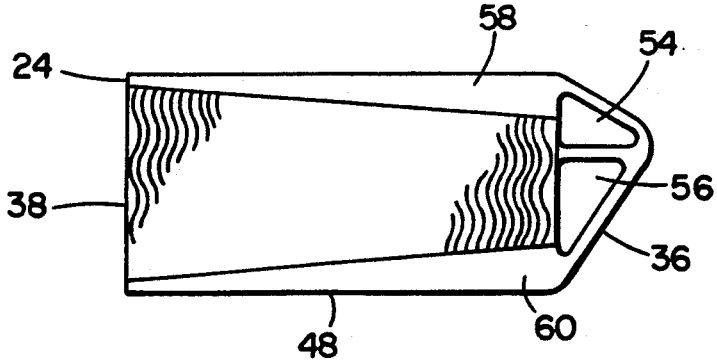
FIG. 9 is a schematic cross-sectional view of an alternate embodiment of the invention.

Referring now to FIG. 9, there is shown an alternate embodiment of the invention. In the embodiment shown, the module 24 generally comprises a center section 48, a first side section 36 and a flat second side section 38. The first side section 36 generally comprises an air inlet conduit 54 and an air outlet conduit 56. As shown in this embodiment, only one side of the module 24 need be provided with a working conduit side section.

The present invention generally combines various features to optimize heat transfer between fluids in a given relatively small volume. The rectilinear shape of the heat transfer surfaces allows a wide variety of materials and fabrication methods to be used to construct thermally efficient heat exchangers which can be used in a minimum volume. The modular construction minimizes physical and thermal stresses and also minimizes the overall volume of the heat exchanger by using the area between rectilinear heat transfer sections for ducting pressurized air to and from the heat exchanger. The polygonal arrangement of the modules can minimize the total system volume including the size of the exhaust gas collector.

Generally, as described above, the function of the recuperator is to transfer heat from the low pressure, high temperature exhaust gases to the high pressure, low temperature air delivered from the compressor and intended to be delivered to the combustors The air cells formed in the heat transfer section 62 must not leak and the construction and materials of the recuperator must be able to withstand the inherent thermal stresses of the recuperator to provide an acceptable working life. The rectilinear shape of the heat transfer surfaces in the center section of the heat transfer module generally allows a wide choice of materials including thin sheet metal, cast finned or convoluted metal, or extruded ceramics. Primary surface, plain or offset plate fins can also be used. Generally, heat transfer is provided by conduiting gases radially outward from the gas inlet side to the gas outlet side and by conduiting air circumferentially through the cross flow region of the center sections, radially inward in the counterflow regions, and circumferentially through the inner cross flow region to the air outlets. As described above, the modules can be placed adjacent to similar modules to form a recuperator with a center aperture of polygonal cross section to provide for axial gas flow. The central region of this center aperture is preferably blocked by a contoured flaring to guide the exhaust gas radially outward. The flaring may also be used to house a power shaft gear box. The gas pressure drop from the gas inlet to the gas outlet is relatively small which allows for the use of a simple thermally and physically flexible seal to be used between modules to minimize gas flow leakage.

Figure 10:
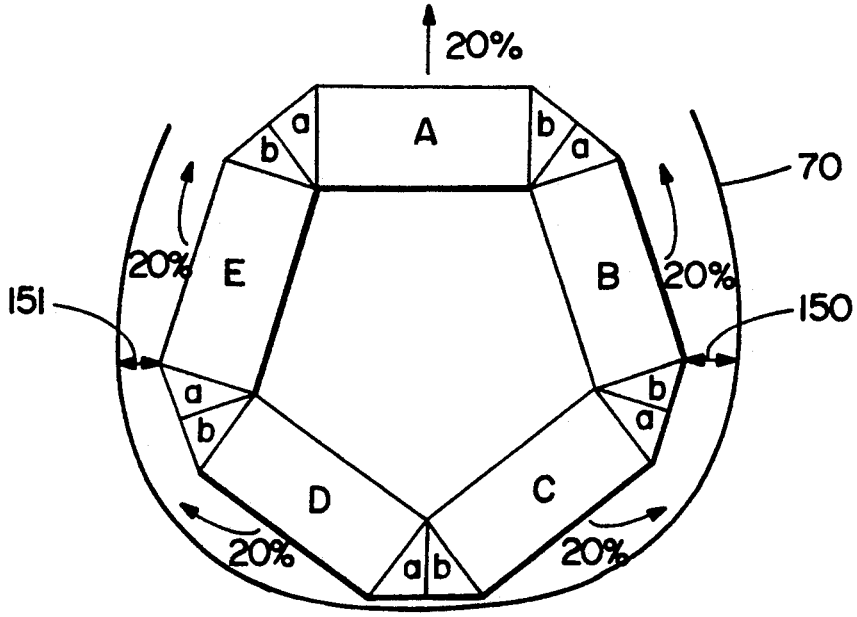
FIG. 10 is a schematic view of the recuperator and gas collector shown in FIG. 5.

Five modules, arranged as a pentagon, provide the maximum heat transfer surface area and cross sectional area available for gas flow for a single exhaust gas discharge perpendicular to the original gas flow axis within a given exhaust gas collector. This arrangement, as shown in FIG. 10, generally illustrates the method for determining the maximum heat exchange performance within a given system volume. To illustrate the method, the recuperator length, the module height, and the gas velocity in the exhaust collector are fixed to allow comparison of different polygonal arrangements.

For the pentagon, 20% of the gas flow passes through each of the five modules. There is no gas flow radially outward at the bottom of the exhaust collector where two bottom air manifolds a and b are located. Radially outward gas flow is collected from the module C and flows counterclockwise in the exhaust collector. Similarly, exhaust gas flows radially outward from module D and flows clockwise in the exhaust collector. The critical flow area that sets the width and, therefore, the volume occurs at the bottom corners of modules B and E indicated at 150 and 151. The collector width at this point must be sized to pass 20% of the total gas flow at each side. For any even number sided polygon shape, the critical area must pass 25% of the gas flow through each side of the collector at the comparable position resulting in a poor surface area/volume which would require a larger collector or a smaller recuperator. The flow area enhancement of the pentagon shape can be computed by comparing its perimeter to the circumference of a tangent circle.

$$\text{(Circle)} \quad C = 2\pi r = 6.28r$$

$$\text{(Pentagon)} \quad P = 5 \times 2 \times \text{Tan } 36r = 7.265\,r$$

$$\text{Ratio} = \frac{7.265r}{6.28r} = 1.157$$

Thus, the flow area enhancement of the pentagon is approximately 16% greater than the flow area for a circle. For a given module height, the heat transfer surface area is also enhanced by an equal amount (16%) relative to a circular recuperator. Thus, for an exhaust collector having a single exhaust gas discharge perpendicular to the original flow axis within a given volume, a pentagon shape provides the greatest flow area and heat transfer surface area.

It should be understood that the foregoing description is only illustrative of the invention. Various alternatives and modifications can be devised by those skilled in the art without departing from the spirit of the invention. Accordingly, the present invention is intended to embrace all such alternatives, modifications, and variances which fall within the scope of the appended claims.

What is claimed is:

1. A heat exchange module for use with a plurality of similar modules to form an annular recuperator for use in a gas turbine engine, the module comprising:

a center section having a generally rectangular cross-sectional shape, said center section having a first gas inlet side, a second opposite gas outlet side and a heat transfer means, said heat transfer means comprising means for conduiting gases from said gas inlet side to said gas outlet side, means for conduiting air through said center section, and rectilinear heat transfer surface means for transferring heat from gases passing through said heat transfer means to air passing through said heat transfer means;

a first side section adjacent a third side of said center section, said first side section having a generally triangular cross-sectional shape with a relatively small portion proximate said first gas inlet side of said center section, said first side section having at least one first air conduit therein communicating with said means for conduiting air in said center section; and a second side section adjacent a fourth side of said center section whereby the module can be placed adjacent similar modules with said first side section of the module being located opposite a second side section of a similar module and said second side section of the module being located opposite a first side section of another similar module to help form a recuperator with a center aperture having first gas inlet sides of the modules substantially defining of a center aperture.

2. A module as in claim 1 wherein the module comprises a plurality of plates fixed together to form the module.

3. A module as in claim 1 further comprising a first end plate and a second end plate.

4. A module as in claim 1 wherein said second side section has a general triangular cross-sectional shape with a relatively small portion proximate said first gas inlet side of said center section.

5. A module as in claim 4 wherein said second side section has at least one second air conduit therein for communicating with said means for conduiting air in said center section.

6. A module as in claim 5 wherein said means for conduiting air in said heat transfer means comprises a first plurality of relatively triangular shaped conduits extending from said at least one first air conduit along a top portion of said heat transfer surface means to allow air to be relatively uniformly delivered to said heat transfer surface means.

7. A module as in claim 6 wherein said means for conduiting air in said heat transfer means comprises a second plurality of relatively triangular shaped conduits extending from said at least one second air conduit along a bottom portion of said heat transfer surface means to allow air to be relatively uniformly removed from said heat transfer surface means.

8. A module as in claim 1 wherein said rectilinear heat transfer surface means comprises a plurality of fluid channels extending generally perpendicular between said gas inlet side and said gas outlet side.

9. A module as in claim 7 wherein said at least one first air conduit can deliver air to said first plurality of relatively triangular shaped conduits relatively evenly.

10. A module as in claim 1 wherein said first side section comprises a first air inlet conduit and a second air outlet conduit.

11. A module as in claim 1 further comprising means for making a sealing engagement of the module with a similar module.

12. A gas turbine engine having a compressor, a combustor, a turbine, a gas exhaust section and a recuperator located in the gas exhaust section for transferring heat from relatively hot exhaust gases to relatively cool air from the compressor for delivery to the combustor, the engine comprising:

at least five heat exchange modules forming said recuperator, each module having a center section with a relatively rectangular cross-sectional shape and at least one side section with a relatively triangular cross-sectional shape, said center section having a heat transfer means therein, said at least one side section having at least one air conduit for conduiting air into said center section with said at least one side section being relatively small proximate a first gas inlet side of said center section, each of said modules having a first side formed by said at least one side section and a second opposite side with said first side of each module being located proximate said second side of an adjacent module to form a polygonal loop, said first gas inlet side of said modules substantially forming a recuperator center aperture; and gas exhaust collector means comprising an exhaust gas collector having a generally U-shaped cross-section with a gas inlet at a front section and a gas outlet at a top section, said recuperator being located in said collector with a first side of a first module and a second side of a second module in close proximity to a bottom section of said collector with a space between said recuperator and said collector whereby gases can enter said recuperator center aperture, pass through said center sections, and exit said recuperator at said space while transferring heat to air passing through said recuperator.

13. An engine as in claim 12 wherein said recuperator comprises five of said modules.

14. An engine as in claim 12 wherein said modules are cantilever mounted in the engine.

15. An engine as in claim 12 wherein said space between said recuperator and said collector increases from bottom to top to accommodate the increased volume of gases passing through said recuperator from bottom to top.

16. An annular heat exchange apparatus adapted for radially conduiting a first fluid from a center aperture to an outer perimeter and adapted for conduiting a second fluid through the apparatus, the apparatus comprising:

a plurality of heat exchange modules, each module having a center section comprising a rectilinear heat exchange means with a first fluid inlet side at said center aperture, a first fluid outlet side at the outer perimeter, and two lateral sides, said first fluid inlet sides substantially defining said center aperture; and a plurality of second fluid conduits located between said lateral sides of said rectilinear heat exchange means of adjacent modules for conduiting the second fluid into and out of said modules such that, by providing said first fluid inlet sides as substantially defining said center aperture and locating the second fluid conduits at the lateral sides of the heat exchange means, the apparatus is relatively compact but with a relatively large first fluid flow area at said first fluid inlet sides.

17. A heat exchanger module for use with a plurality of similar modules to form an annular heat exchanger, the module comprising:

a center section having a first gas inlet side, a second opposite gas outlet side and a heat transfer means, said heat transfer means comprising means for conduiting gases from said gas inlet side to said gas outlet side and means for separately conduiting air through said center section such that heat from gases passing through said heat transfer means can be transferred to air passing through said heat transfer means;

a first side section adjacent a third lateral side of said center section, said first side section having a generally triangular cross-section shape with a relatively small portion proximate said first gas inlet side of said center section and having at least one first air conduit therein communicating with said means for conduiting air in said center section; and means for exiting air from said heat transfer means including at least one second air conduit located on a lateral side of said center section such that said first and second air conduits are substantially located away from said gas inlet side thereby allowing gas inlet sides of a plurality of modules to be compactly spaced relative to each other at said gas inlet sides.

18. A heat exchange module for use with a plurality of similar modules to form a heat exchanger, the module comprising:

means for exchanging heat from a first fluid to a second fluid comprising a substantially rectilinear heat exchanger;

means for conduiting a first fluid into, through, and out of said rectilinear heat exchanger in a substantially straight linear direction; and means for conduiting a second fluid into and out of said heat exchanger including at least one inlet conduit and at least one outlet conduit, said inlet and outlet conduits being located proximate at least one lateral side of said rectilinear heat exchanger, said means for conduiting a second fluid having a relatively small cross-sectional shape proximate a first fluid inlet side of said rectilinear heat exchanger such that modules can be positioned next to each other with said inlet and outlet conduits being located between rectilinear heat exchangers.

19. An annular heat exchanger comprising:

a plurality of rectilinear heat transfer portions, each portion having a first fluid inlet side, an opposite first fluid outlet side, and two lateral sides;

means for conduiting a second fluid into and out of said heat transfer portions comprising lateral side portions located between heat transfer portion lateral sides and having a general triangular shape with second fluid inlet and outlet conduits therein, said first fluid inlet sides defining a center aperture and said lateral side portions being substantially separate from said center aperture such that said first fluid inlet sides form substantially the entire first fluid inlet area to the heat exchanger and the location of the lateral side portions allow the heat exchanger to have a relatively small size.

* * * * *